US009534302B2

(12) United States Patent
Hoedl et al.

(10) Patent No.: US 9,534,302 B2
(45) Date of Patent: Jan. 3, 2017

(54) DEVICE AND METHOD FOR POST-TREATING A METAL STRIP

(71) Applicant: SIEMENS VAI METALS TECHNOLOGIES GMBH, Linz (AT)

(72) Inventors: Stefan Hoedl, Puchenau (AT); Klaus Kofler, Linz (AT); Josef Speidl, Traun (AT); Alois Stadlbauer, Engerwitzdorf (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 216 days.

(21) Appl. No.: 14/351,407

(22) PCT Filed: Oct. 11, 2012

(86) PCT No.: PCT/EP2012/070132

§ 371 (c)(1),
(2) Date: Apr. 11, 2014

(87) PCT Pub. No.: WO2013/053804

PCT Pub. Date: Apr. 18, 2013

(65) Prior Publication Data

US 2014/0230853 A1 Aug. 21, 2014

(30) Foreign Application Priority Data

Oct. 14, 2011 (EP) ..... 11185215

(51) Int. Cl.
*B08B 3/02* (2006.01)
*B08B 1/02* (2006.01)
(Continued)

(52) U.S. Cl.
CPC ..... *C23G 3/029* (2013.01); *B08B 3/02* (2013.01); *B08B 3/022* (2013.01); *B08B 3/041* (2013.01)

(58) Field of Classification Search
CPC ..... B08B 3/02; B08B 3/022; B08B 3/041; C23G 3/029; C23G 3/02
(Continued)

(56) References Cited

U.S. PATENT DOCUMENTS 6,609,530 B1 * 8/2003 Koza ..... B08B 3/022 134/122 R

FOREIGN PATENT DOCUMENTS

AT 404 472 11/1998
CN 2692165 * 4/2005
(Continued)

OTHER PUBLICATIONS

Office Action dated Nov. 23, 2016 issued in corresponding Chinese Patent Application No. 201280050403.6 with English translation.
(Continued)

*Primary Examiner* — Saeed T Chaudhry
(74) *Attorney, Agent, or Firm* — Ostrolenk Faber LLP

(57) ABSTRACT

A device and method for post-treating a metal strip, wherein a pickled metal strip (2) coming from a pickling zone is advanced continuously through a rinsing zone (4) in which residues of a pickling agent adhering to the surface (11) of the metal strip (2) are removed by spraying the metal strip with rinsing fluid. At least one device (8) for generating a liquid mist (9) is provided in the rinsing zone (4). The device (8) can moisten the surface (14) of the metal strip (2) during an interruption of the continuous operation or of a sharply reduced speed of the strip. The device (8) has mist spraying jets above the surfaces of the metal strip.

15 Claims, 2 Drawing Sheets

(51) Int. Cl.
*C23G 1/02* (2006.01)
*C23G 3/02* (2006.01)
*B08B 3/04* (2006.01)

(58) Field of Classification Search
USPC ..... 134/15, 64 R
See application file for complete search history.

(56) References Cited

FOREIGN PATENT DOCUMENTS

| | | | |
|---|---|---|---|
| CN | 2692165 | Y | 4/2005 |
| CN | 2692165 | Y | 4/2005 |
| CN | 201648525 | U | 11/2010 |
| JP | 2006 045594 | | 8/1986 |
| JP | 2006045594 | | 8/1986 |
| JP | 61 195984 | | 11/1990 |
| JP | 2 270977 | | 2/2006 |
| JP | 2006045594 | * | 2/2006 |

OTHER PUBLICATIONS

International Search Report dated Dec. 17, 2012 issued in corresponding International patent application No. PCT/EP2012/070132.
International Preliminary Report on Patentability dated Jan. 10, 2014 issued in corresponding International patent application No. PCT/EP2012/070132.

* cited by examiner

Section A-A or

DEVICE AND METHOD FOR POST-TREATING A METAL STRIP

CROSS-REFERENCE TO RELATED APPLICATIONS

The present application is a 35 U.S.C. §§371 national phase conversion of PCT/EP2012/070132, filed Oct. 11, 2012, which claims priority of European Application No. 11185215.8, filed Oct. 14, 2011, the contents of which are incorporated by reference herein. The PCT International Application was published in the German language.

The invention relates to a device and a method for post-treating a metal strip, wherein the pickled metal strip coming from a pickling zone is moved in continuous operation through a rinsing zone in which residues of a pickling agent adhering to the surface of the metal strip are removed by spraying the metal strip with a rinsing fluid.

PRIOR ART

It is a known method to treat the surface of a metal strip with a pickling agent, for example with an acid, in order to remove scale from the metal strip. In this situation, the metal strip is moved continuously through a pickling zone in continuous operation. The pickling process is followed by a zone of post-treatment in which residues of the pickling agent are cleaned from the metal strip. This typically takes place in a rinsing zone which for the most part consists of a plurality of rinsing stages. Rinsing nozzles which spray a rinsing fluid onto the surfaces of the metal strip are provided above and below the metal strip in the rinsing stages. The rinsing agent is for the most part re-circulated. Water is normally used as the rinsing agent, which may also contain chemical additives.

For operational reasons interruptions may occur in the continuous operation. If the movement of the metal strip in a rinsing zone is stopped or sharply reduced (e.g. a sharply reduced speed of the strip), then this may result in the formation of so-called "spray patterns" and in undesirable discolorations of the surface of the strip. "Spray patterns" are irregularities adhering to the surface of the metal strip which impair the quality of the pickled metal strip and are undesirable. Said "spray patterns" are for example caused by the fact that the spray jet strikes only a limited area of the surface while the strip is at a standstill.

However, even if the rinsing process is disabled while the strip is at a standstill, the residual quantity of the rinsing fluid remaining on the strip dries on account of the strip being at a temperature of up to 80° C. Irregularities, for example brown marks, are generated on the surface. Said brown marks are caused by a formation of iron(III) hydroxide taking place at the surface. Iron(III) hydroxide is not soluble in water.

A method for post-treating pickled steel strip is known from AT 404 472 B, in which the metal strip is flooded in the rinsing zone in the event of the plant coming to a standstill. Such flooding, which must take place until the strip is fully covered, is an elaborate process.

The above problem can also be dealt with by moving the affected strip section back into the pickling zone again after the strip has come to a standstill. The brown coloration is thereby pickled and thus removed. Such a process requires a reversal of the direction of movement of the strip, which reduces the output.

Overall, the problem of the adverse effect resulting from a standstill condition on the surface quality of a pickled metal strip has hitherto not been satisfactorily resolved.

DESCRIPTION OF THE INVENTION

The object of the present invention is to specify a device and a method for post-treating a pickled metal strip such that in the event of an interruption in the continuous operation or of a sharply reduced speed of the strip, a high surface quality of the metal strip is maintained without needing to move the strip back.

This object is achieved by a device and a method of the invention.

According to the fundamental idea of the invention, in the event of the strip coming to a standstill or of a sharply reduced speed of the strip, the metal strip is held in a moist atmosphere in the rinsing zone. This is done by generating a liquid mist which serves to moisten the surface of the metal strip such that atmospheric oxygen does not reach the surface of the metal. The liquid mist is generated by means of suitable units, for example by means of atomizer nozzles. This process is also referred to in the following as standstill spraying. The device according to the invention for post-treatment is therefore comprises a unit provided in the rinsing zone for generating a liquid mist. By means of the liquid mist, the surface of the metal strip can be moistened in the event of an interruption in the continuous operation or of a sharply reduced speed of the strip. The unit for generating the liquid mist is separate from the rinsing nozzles and essentially consists of separate nozzles, also referred to as spray nozzles in the following. As a result of misting with a liquid (for example: deionized water), the surface of the metal strip remains moist during a standstill or a sharply reduced speed of the strip. In the event of a standstill, the invention has the advantage that limited plant standstill times can be bridged without strip reversal and without any loss of quality with comparatively little effort. As a result of not moving the strip back, this time can be utilized for production. This increases the efficiency of the plant.

Since a rinsing zone normally consists of a plurality of rinsing stages, the misting of the strip takes place in the individual rinsing stages. This means that the problem of surface impairments caused by a standstill (or a sharply reduced speed of the strip) can be solved with comparatively little effort. It is intended to provide the moistening according to the invention of the respective strip section in at least one or each of the rinsing stages.

In a preferred embodiment it is intended that the unit for generating the liquid mist is arranged in each case on the side walls of a rinsing stage. This means that the liquid mist discharges laterally in each case from the side walls into the interior space of the respective rinsing stage. This results in an even distribution of mist in the interior space.

In order to achieve as even a moistening as possible of the surface of the metal strip, it can furthermore be advantageous if the spray nozzles are arranged either in a plane predefined by the pass line of the metal strip, or in planes above and below the front end of the strip (pass line) and their spray jet is directed perpendicular to the direction of strip movement. This means that the distribution of the mist in the interior space of the rinsing stages can be performed evenly.

The present object is also achieved by a method for post-treating a metal strip, wherein the pickled metal strip coming from a pickling zone is moved in continuous operation through a rinsing zone in which residues of a pickling agent adhering to the surface of the metal strip are removed. The method according to the invention is characterized in that in the event of an interruption in the continuous operation or of a sharply reduced strip movement the spraying-on of the rinsing fluid is stopped zone-wise or completely and a liquid mist is generated by means of a unit provided in the rinsing zone, and the surface of the metal strip is thereby kept moist.

In the light of past experience, in the event of the strip coming to a standstill or of a sharply reduced speed of the strip, the undesirable spray patterns and discolorations may occur in any rinsing stage. When avoiding said adverse effects, it is therefore particularly efficient if a standstill spraying process is carried out at least in one rinsing stage. During the standstill spraying operation, the application of the rinsing fluid while the strip is running is disabled. For the introduction of the liquid mist, it can be expedient if special nozzles are used for this purpose which are arranged laterally in the rinsing stage. In this situation, it is expedient if the spray nozzles are integrated in the side walls of the rinsing stage. This means that the moistening can take place homogeneously over the surface of the strip.

Even or uniform moistening of the surface of the strip can be achieved by means of arranging the (mist) spray nozzles either in a plane predefined by the pass line of the metal strip or in adjacent planes arranged above and below the pass line, and the spray direction is defined as perpendicular to the direction of movement of the metal strip.

BRIEF DESCRIPTION OF THE DRAWINGS

For further explanation of the invention reference is made to the drawings in the following part of the description from which further advantageous embodiments, details and developments of the invention can be derived on the basis of non-limiting exemplary embodiments.

In the drawings.

EMBODIMENT OF THE INVENTION

Figure 1:
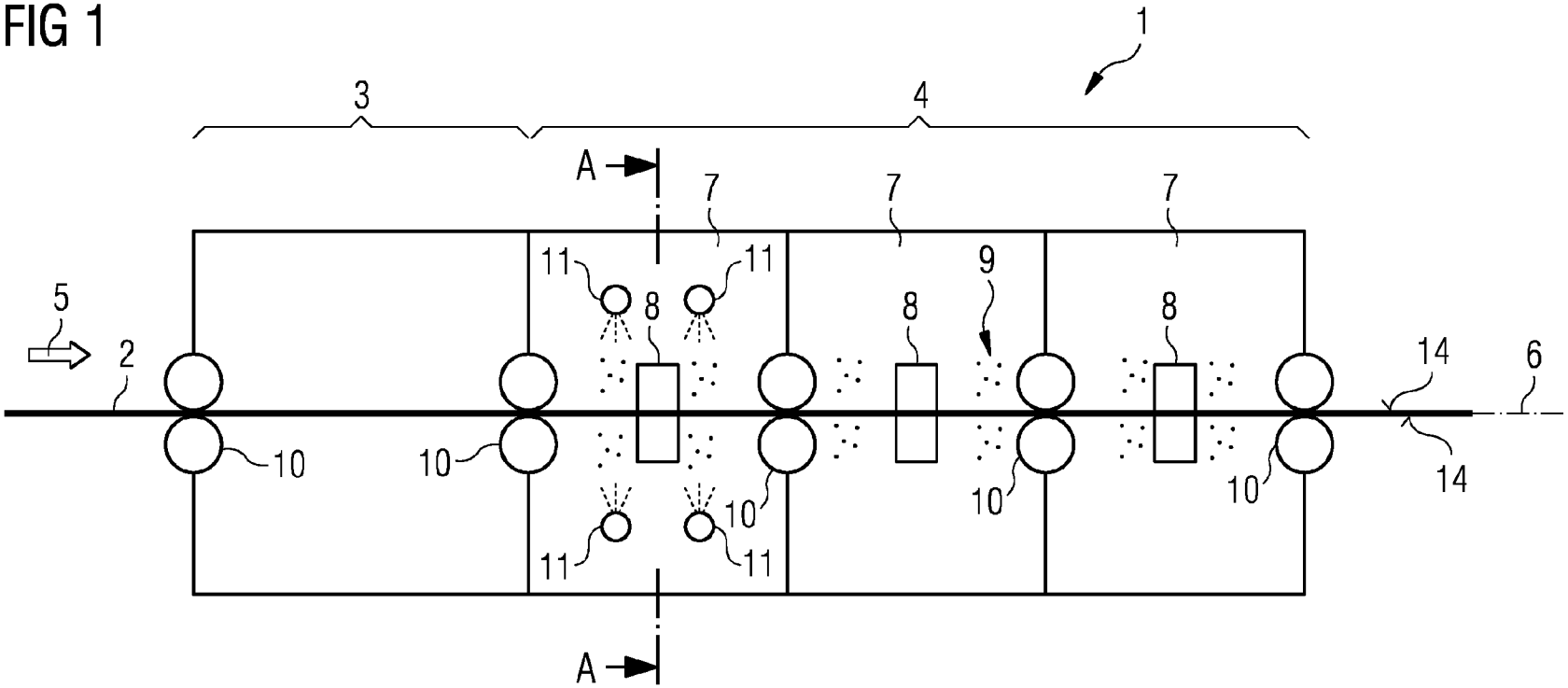
FIG. 1 shows a schematic illustration of a treatment plant for metal strips, comprised of a pickling zone and a rinsing zone arranged downstream thereof which comprises a plurality of rinsing stages.

FIG. 1 shows a schematic illustration of a treatment plant 1 for metal strips. The treatment plant 1 comprises a pickling zone 3 and a rinsing zone 4 arranged downstream thereof, in which the pickled metal strip 2 is post-treated. In FIG. 1 the metal strip 2 is moved according to the arrow 5 from left to right along the pass line 6 through the treatment plant 1. In the example illustrated the rinsing zone 4 comprises three rinsing stages 7 arranged in succession in each of which rinsing nozzles 11 (not illustrated in more detail) spray a rinsing fluid onto the upper side and onto the lower side of the metal strip 2 and thereby remove from the opposite surfaces of the strip 14 the residues of the pickling agent carried through from the pickling zone 3.

According to the invention, at least in one of the rinsing stages 7 a unit 8 is situated for generating a liquid mist 9 which is used to moisten the section of the metal strip 2 situated in that rinsing stage 7 in the event of the strip coming to a standstill or of a sharply reduced speed of the strip. A liquid, for example deionized water, is used in order to generate the mist 9.

At the inlet and at the outlet in each case of the pickling zone 3 and/or at the inlet and outlet of each rinsing stage 7 squeezing rollers 10 are situated, which squeeze the respective treatment liquid from the surface of the strip 14 and thus retain it in the respective treatment zone.

Figure 2A:
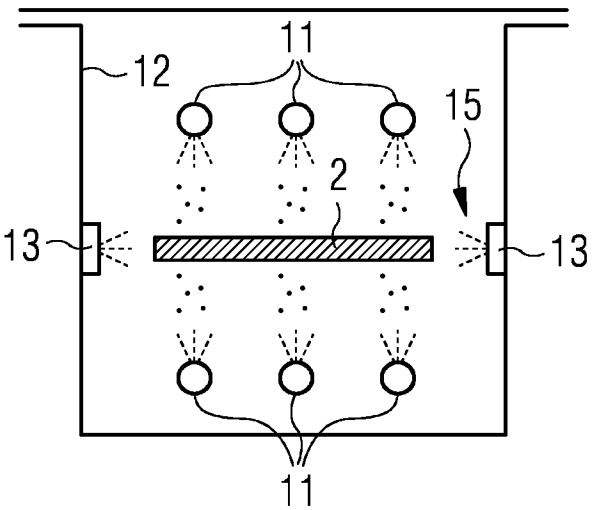
FIGS. 2*a* and 2*b* show a sectional illustration of a rinsing stage.
Figure 2B:
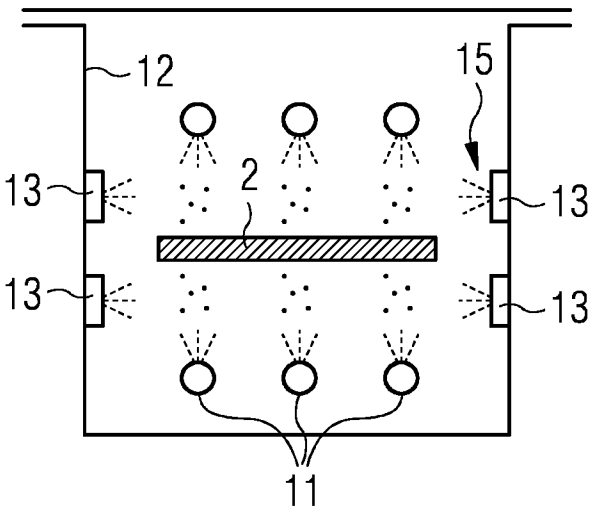

FIGS. 2*a* and 2*b* show a cross-section through a rinsing stage 7. The rinsing nozzles 11 spray the opposite surfaces of the metal strip 14 with a rinsing agent in order that residues of the pickling agent are removed from the surfaces of the strip 14. The rinsing nozzles 11 are connected by supply lines with a supply facility which is not illustrated in more detail. The rinsing agent is collected in a tank as a basis and re-circulated.

A row of spray nozzles 13 at the height of the pass line in each case on the side walls is illustrated in FIG. 2*a*. Two rows of spray nozzles 13 in each case per side above and below the pass line are illustrated in FIG. 2*b*. They constitute an atomizer unit by means of which a liquid (as a general rule pure water) is atomized to a mist. Said liquid mist 9 is introduced into the interior space of the rinsing stage 7 from the side. In the event of the strip coming to a standstill or of a sharply reduced speed of the strip (the delivery of the rinsing fluid to the rinsing nozzles 11 is stopped zone-wise or completely) the surface of the metal strip 14 is kept moist by means of said liquid mist 9 in order that the formation of "spray patterns" and undesirable discolorations on the surface are prevented. As a result of this atmosphere in the interior space of the rinsing stage 7, the "spray patterns" and undesirable discolorations can be prevented for a limited time. In the case of the strip coming to a standstill, according to the invention, it is therefore no longer necessary within a limited time to move the strip section in the rinsing zone 4 back into the pickling zone 3.

When viewed in the direction of strip movement 5, the spray nozzles 13 are arranged on a line which lies either at the height of the pass line 6 of the rinsing zone 7 (FIG. 2*a*) or on lines arranged above and below the pass line (FIG. 2*b*). The spray mist jet 15 points in a direction perpendicular to the direction of strip movement 5.

A preferred embodiment of the spray nozzles 13 can be either a single-fluid nozzle (for example: full-cone nozzle) or a two-fluid nozzle.

Although the invention has been illustrated and described in detail by means of the preferred exemplary embodiment, the invention is not restricted by the disclosed examples and other variations can be derived therefrom by the person skilled in the art without departing from the scope of protection of the invention.

A rinsing zone 4 can naturally also comprise more than three rinsing stages 7 arranged in succession. As described above, the problem of the "spray patterns" occurs in the event of the strip coming to a standstill or the problem of undesirable discolorations occurs in the event of the strip coming to a standstill or of a sharply reduced speed of the strip.

LIST OF REFERENCE CHARACTERS USED

1 Treatment plant
2 Metal strip
3 Pickling zone
4 Rinsing zone
5 Direction of movement of metal strip
6 Pass line
7 Rinsing stage
8 Unit for generating the liquid mist
9 Liquid mist

10 Squeezing rollers
11 Rinsing nozzle
12 Side wall
13 Spray nozzle
14 Surface of strip
15 Spray mist jet

The invention claimed is:

1. A device for post-treating a pickled metal strip comprising:

a device for advancing a pickled metal strip in continuous operation through a rinsing zone through which the pickled metal strip is advanced, the rinsing zone is comprised of a plurality of rinsing stages arranged in succession;

a spraying apparatus in the rinsing zone configured to remove residues of a pickling agent adhering to a surface of the metal strip by spraying a rinsing agent on the surface of the strip;

in response to an interruption in continuous operation or of a sharply reduced speed of advancing of the strip, the rinsing zone is configured to interrupt the spraying of the rinsing fluid zone-wise or completely;

a unit provided at least in one of the rinsing stages in the rinsing zone, for generating a liquid mist, and the unit is configured for moistening the surface of the metal strip; and the unit comprises atomizing nozzles that generate the liquid mist, the atomizing nozzle being arranged at lateral sides of the at least one rinsing stage to introduce the liquid mist in a direction perpendicular to the direction of movement of the metal strip, toward the edges of the metal strip, and parallel to the opposing surfaces of the metal strip.

2. The device as claimed in claim 1, wherein the unit is comprised of one or more spray nozzles each arranged at one of the sides of the respective stage.

3. The device as claimed in claim 2, wherein the spray nozzles are arranged in a plane predefined by the pass line of advancing of the metal strip.

4. The device as claimed in claim 2, wherein the spray nozzles are each arranged respectively above or below the pass line of advance of the metal strip.

5. The device as claimed in claim 4, wherein the spray nozzles arranged in the unit are embodied as single-fluid nozzles.

6. The device as claimed in claim 4, wherein the spray nozzles arranged in the unit are embodied as two-fluid nozzles.

7. The device as claimed in claim 2, wherein the at least one rinsing stage has side walls at the lateral sides.

8. The device as claimed in claim 1, wherein the spray nozzles are in at least one of above and below the advancing metal strip.

9. The device as claimed in claim 1, wherein the at least one rinsing stage has side walls at the lateral sides thereof and the unit is located at the side walls.

10. A method for post-treating a pickled metal strip, comprising:

advancing the pickled metal strip to move in continuous operation through a rinsing zone and removing residues of a pickling agent adhering to the surface of the metal strip in the rinsing zone by spraying of rinsing fluid onto the metal strip;

in response to an interruption in the continuous advancing operation of the strip or of a sharply reduced speed of advancing of the strip, interrupting the spraying of the rinsing fluid zone-wise or completely; and generating a liquid mist with a unit provided in the rinsing zone for keeping the surface of the metal strip moist at least when continuous advancing is interrupted or is at a reduced speed; and introducing the liquid mist from lateral sides of the at least one rinsing stage in a direction perpendicular to the direction of strip advancement, toward edges of the strip, and parallel to opposing surfaces of the strip.

11. The method as claimed in claim 10, wherein the rinsing zone is comprised of a plurality of rinsing stages, wherein at least in one of the rinsing stages, a section of the advancing metal strip then located in the at least one of the rinsing stages is additionally or alternatively kept moist by means of the liquid mist.

12. The method as claimed in claim 10, further comprising generating the spray mist by spray nozzles which are arranged in a plane predefined by and above or below a pass line of advance of the metal strip.

13. The method as claimed in claim 10, further comprising generating the spray mist jet by spray nozzles which are arranged in planes above and below the pass line of the advance of metal strip.

14. The method as claimed in claim 10, further comprising introducing the liquid mist by means of single-fluid nozzles.

15. The method as claimed in claim 10, further comprising introducing the liquid mist by means of two-fluid nozzles.

* * * * *